US007765771B2

(12) United States Patent
Serpico et al.

(10) Patent No.: US 7,765,771 B2
(45) **Date of Patent: *Aug. 3, 2010**

(54) STRUCTURAL FRAMING SYSTEM AND COMPONENTS THEREOF

(75) Inventors: Fred Serpico, Fayetteville, GA (US); Rahim Zadeh, Mableton, GA (US)

(73) Assignee: Ware Industries, Inc., South Plainfield, NJ (US)

( * ) Notice: Subject to any disclaimer, the term of this patent is extended or adjusted under 35 U.S.C. 154(b) by 1186 days.

This patent is subject to a terminal disclaimer.

(21) Appl. No.: 10/961,561

(22) Filed: Oct. 8, 2004

(65) Prior Publication Data

US 2006/0096229 A1 May 11, 2006

(51) Int. Cl.
*E04C 3/00* (2006.01)

(52) U.S. Cl. ..... 52/846; 52/241; 52/656.1; 52/696

(58) Field of Classification Search ..... 52/241, 52/665, 656.1, 654.1, 696, 731.7, 846
See application file for complete search history.

(56) References Cited

U.S. PATENT DOCUMENTS 2,106,084 A * 1/1938 Coddington ..... 52/376
2,235,761 A 3/1941 Goldsmith
2,275,109 A 3/1942 McGee
2,410,922 A 11/1946 Balduf
3,001,615 A * 9/1961 Ries ..... 403/230
3,169,614 A * 2/1965 McCoy ..... 52/506.06
3,217,452 A 11/1965 Steele
D203,133 S 12/1965 Senek et al.
3,293,813 A * 12/1966 Emmons et al. ..... 52/238.1
3,536,345 A * 10/1970 Leifer ..... 52/737.6
3,845,601 A * 11/1974 Kostecky ..... 52/290

(Continued)

OTHER PUBLICATIONS

Marino/Ware Quality and Serivce Count—Warewall—Snap-In Drywall Framing System Brochure.

*Primary Examiner*—Basil Katcheves
(74) *Attorney, Agent, or Firm*—Lucas & Mercanti, LLP

(57) ABSTRACT

A structural framing system comprising at least one first framing component having upper and lower flange elements separated by a web element having a depth measured between the upper and lower flange elements, the upper and lower flange elements having positioning dimples spaced thereal-ong, the upper dimples protruding from the upper flange element toward the lower flange element and the lower dimples protruding from the lower flange element toward the upper flange element in such manner that a distance between the upper and lower dimples is less than the depth of the web, at least one second framing component having a depth adapted to fit between the upper and lower flange elements of the first framing component and extending from positions along the first framing component substantially correspond-ing to the locations of the corresponding upper and lower positioning dimples, and at least one third framing compo-nent for securing together the first and second framing com-ponents, comprising a first plate member adapted to be secured to the web of the first framing component having a height substantially equal to the depth of the web of the first framing component, and a second plate member adapted to be secured to a surface of the second framing component, a portion thereof having a height less than the distance between the upper and lower dimples so as to avoid interference with the dimples during attachment of the third framing compo-nent to the first and second framing components.

11 Claims, 5 Drawing Sheets

U.S. PATENT DOCUMENTS

| | | | | | |
|---|---|---|---|---|---|
| 3,852,927 | A | | 12/1974 | Birum, Jr. | |
| 4,018,020 | A | * | 4/1977 | Sauer et al. | 52/241 |
| 4,492,066 | A | | 1/1985 | La Londe | |
| 4,739,918 | A | | 4/1988 | Stokes et al. | |
| 4,805,364 | A | | 2/1989 | Smolik | |
| 4,809,476 | A | | 3/1989 | Satchell | |
| 4,854,096 | A | | 8/1989 | Smolik | |
| 4,918,899 | A | * | 4/1990 | Karytinos | 52/690 |
| 5,157,883 | A | * | 10/1992 | Meyer | 52/357 |
| 5,222,335 | A | * | 6/1993 | Petrecca | 52/105 |
| 5,325,651 | A | * | 7/1994 | Meyer et al. | 52/715 |
| 5,625,995 | A | * | 5/1997 | Martin | 52/715 |
| 5,660,012 | A | * | 8/1997 | Knudson | 52/241 |
| 5,809,724 | A | | 9/1998 | Bodnar | |
| 6,170,217 | B1 | * | 1/2001 | Meyer | 52/693 |
| 6,263,634 | B1 | | 7/2001 | Bodnar et al. | |
| 6,568,138 | B1 | * | 5/2003 | Frost et al. | 52/241 |
| 6,761,005 | B1 | * | 7/2004 | Daudet et al. | 52/272 |
| 6,792,733 | B2 | * | 9/2004 | Wheeler et al. | 52/656.1 |
| 6,802,169 | B2 | * | 10/2004 | Simmons | 52/648.1 |
| 7,127,862 | B2 | * | 10/2006 | Saldana | 52/715 |

* cited by examiner

STRUCTURAL FRAMING SYSTEM AND COMPONENTS THEREOF

BACKGROUND OF THE INVENTION

This invention relates to a structural framing system and components thereof, preferably for use in buildings and other such structures. Buildings have long been constructed of structural framing systems. For example, most homes are constructed of an all wood frame consisting of 2×4s, 2×6s, etc. and plywood to create the overall frame of the outside of the house and the interior walls. Obviously, other materials and equipment are also used, but the essential framing of the structure is of wood. In recent times, and usually, but not always, for use in commercial real estate structures, steel and/or other metal alloy structural components have been created to replace the wood framing components.

An improved steel or other metal alloy structural framing component and component system is the subject hereof.

SUMMARY OF THE INVENTION

A structural framing system is provided. The system comprises at least one first framing component having upper and lower flange elements separated by a web element, the web having a depth as measured between the upper and lower flange elements, the upper and lower flange elements having corresponding upper and lower positioning dimples spaced therealong, the dimples protruding from the upper flange element toward the lower flange element and the lower dimples protruding from the lower flange element toward the upper flange element in such manner that a distance between a lower most surface of the upper dimples and an upper most surface of the lower dimples is less than the depth of the web, at least one second framing component having a depth adapted to fit between the upper and lower flange elements of the first framing component, the second framing component further adapted to extend from positions along the first framing component substantially corresponding to a pair of the corresponding upper and lower positioning dimples, and at least one third framing component for securing together the first and second framing components, the third framing component comprising a first plate member adapted to be secured to the web of the first framing component and having a height substantially equal to the depth of the web of the first framing component, a second plate member adapted to be secured to a surface of the second framing component, a portion of the second plate member having a height less than the distance between the surfaces of the dimples so as to avoid interference with the dimples during attachment of the third framing component to the first and second framing components.

Other objects of the invention will impart the obvious and will impart the apparent from the following description.

The invention accordingly comprises assemblies and components possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
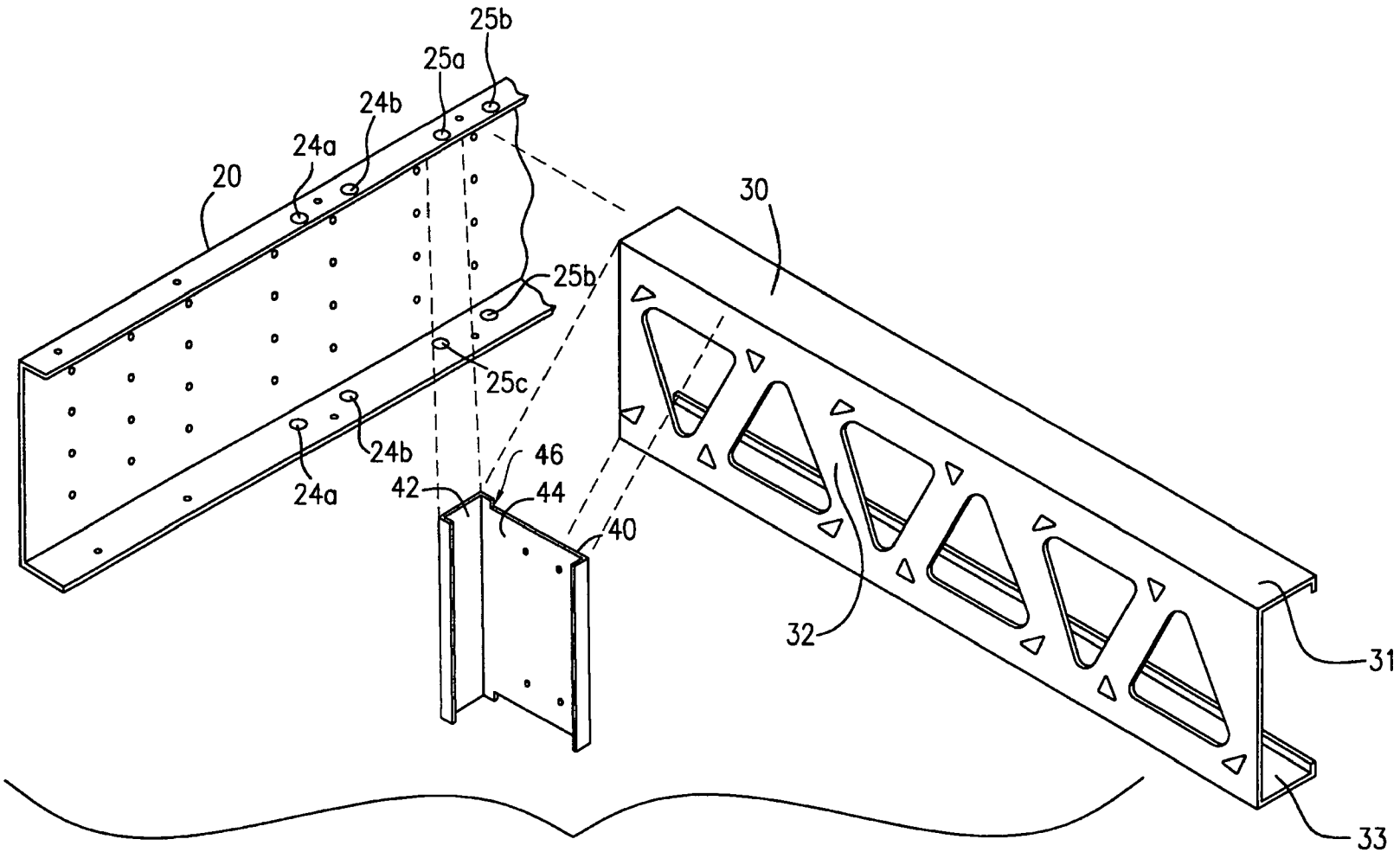
FIG. 1 is an exploded perspective view of a structural framing system encompassed by the scope of the invention.
Figure 6:
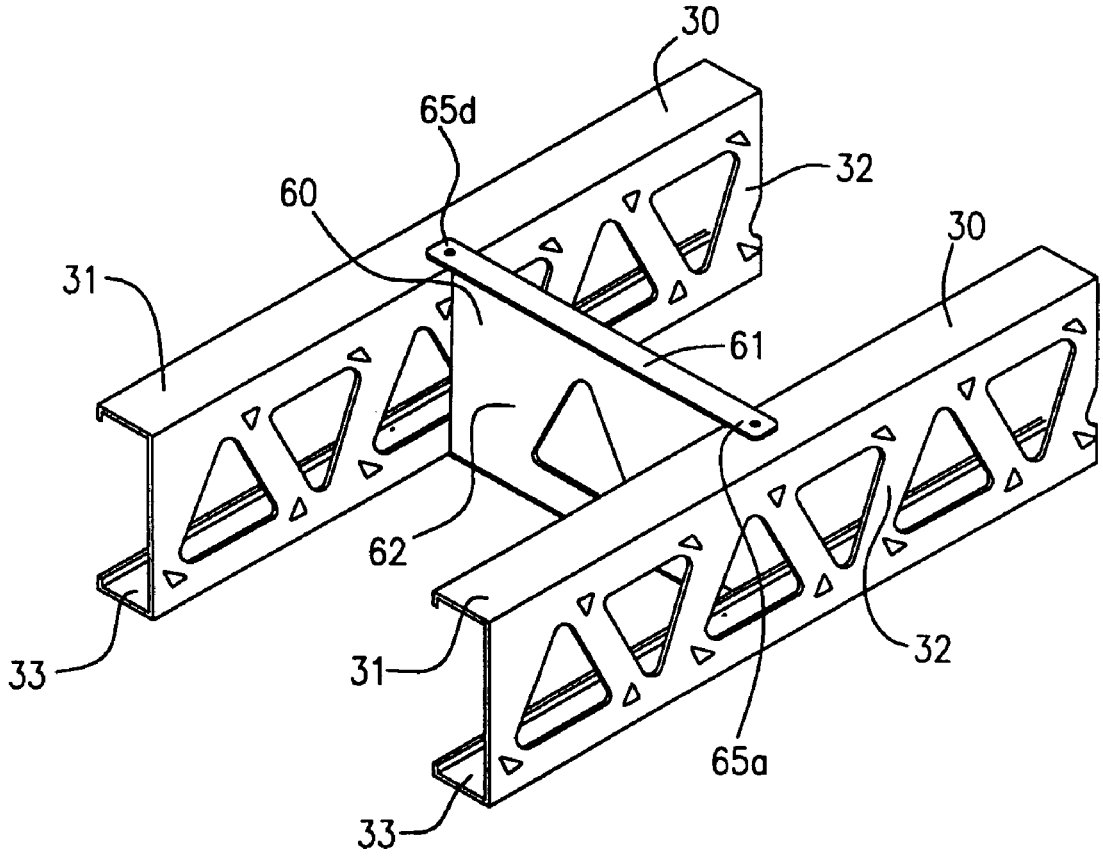
FIG. 6 is a perspective view showing connection of the blocking structural framing component of FIG. 5 to adjacent joists of a structural framing system.

As seen in FIG. 1, a structural framing system is shown at 10. System 10 includes at least framing components 20, 30 and 40. As shown in FIG. 6, system 10 may also include framing component 60, used between two of components 30 to help stabilize the system. Usually system 10 will include a plurality of components 20, 30, 40 and 60.

Figure 2:
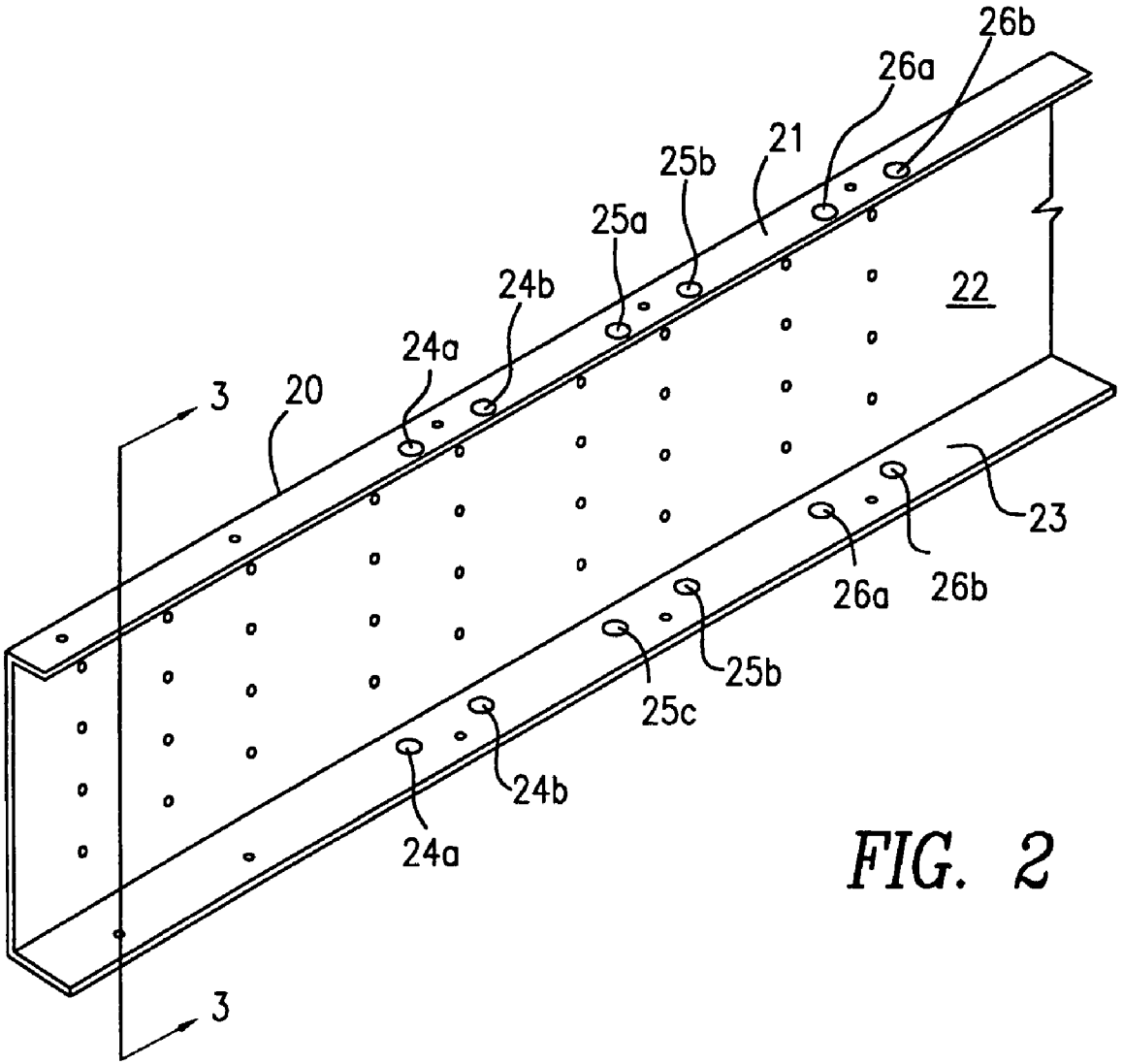
FIG. 2 is a perspective view of a joist track component.
Figure 3:
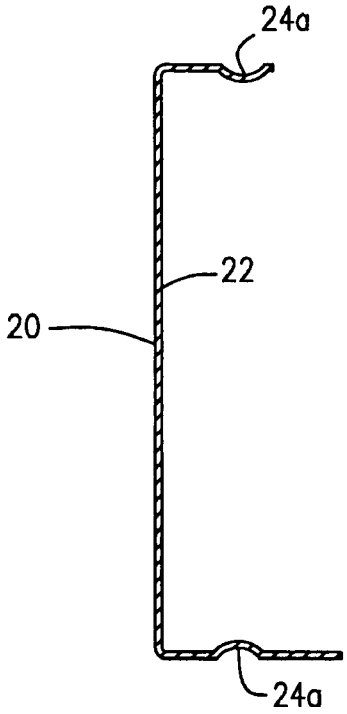
FIG. 3 is a cross sectional view taken along line 3-3 of FIG. 2.

Directing attention to FIGS. 2 and 3, track component 20 is seen to have a web 22 and first and second flange members 21 and 23 separated from each other by a depth "D" of web 22. Spaced along flanges 21 and 23 are dimples 24*a*, 24*b*, 25*a*, 25*b*, 26*a*, 26*b*, etc. In a preferred, but not mandatory, embodiment the dimples are paired together along first and second flanges 21 and 23 in such a way that dimples 24*a* and *b* on first flange 21 are essentially vertically in line with dimples 24*a* and *b* of flange 23, and the space between dimples 24*a* and 24*b* along both flanges 21 and 23 are designed to loosely hold the thickness of flange elements 31 and 33 of frame components 30 (as best seen in FIG. 1). However, use of a single dimple on the first flange and a corresponding single dimple on the lower, second flange for easy alignment purposes of components 30, is also anticipated.

As seen in FIG. 3, dimples 24, 25, 26, etc. of first flange 21 extend in a direction toward second flange 23, while dimples 24, 25, 26, etc. of lower flange 23 extend in an upward direction toward flange 21. Track components 20 are designed to correspond to and fit with components 30, so that the depth of components 30 (as measured between flanges 31 and 33), fit between flanges 21 and 23 of components 20. The height "H" of dimples 24, 25 and 26, etc. must at least be such that when second flange 33 of component 30 is resting on flange 23 of component 20 the dimples extending downward from flange 21 far enough so as to retain component 30 in an upright position prior to securing the components together.

Figure 4A:
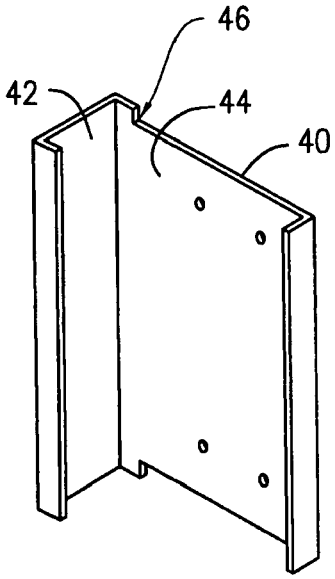
FIGS. 4*a* and 4*b* are perspective views of web stiffener structural framing components.

Turning now to a discussion of FIG. 4, in a preferred embodiment component 40 is seen to have a first plate member 42 and a second plate member 44. First plate member 42, as seen in FIG. 1, abuts against web 22 of component 20, while second plate member 44, as also seen in FIG. 1, abuts against web 32 of component 30. There are predrilled holes 45 in second plate member 44 for aiding securement to web 32. It is shown in FIG. 4 that the preferred angle between plates 42 and 44 of component 40 is ninety degrees, as the usual case will be for component 30 to be extending perpendicularly from component 20 of system 10. However, it is anticipated herein that angles ranging between 0 and 180 degrees are possible for the angle of connection between components 30 and 20, and therefore between first and second plates 42 and 44 of component 40. Such construction angles are typically determined with regard to aesthetics and strength considerations.

Figure 4B:
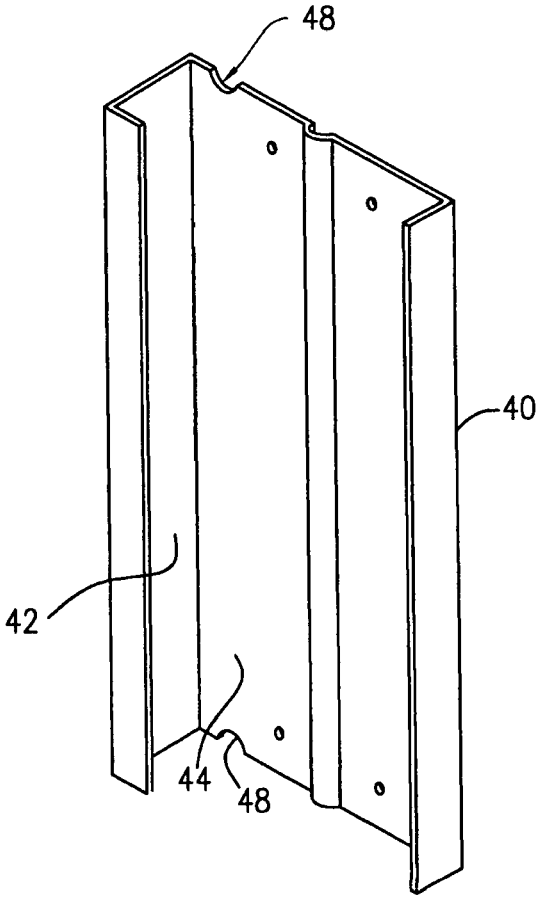

In order for component 40 to be easily and quickly secured onto webs 22 and 32 of components 20 and 30, respectively, with minimization of interference with the placement thereof by the dimples extending downward and upward from flanges 21 and 23 of component 20, it is seen in FIG. 4 that second plate 44 while starting out at a length substantially equivalent to that of plate 42, thereafter has continuous notch 46 so as to be shorter in length and therefore pass either above and/or below the respective dimple found approximate to, and loosely retaining, component 30. In another embodiment instead of plate 44 having this lower, notched length for the remainder of the width of plate 44, FIG. 4*b* shows a non-continuous notch 48 in the top and bottom edges of plate 44; i.e., after notch 48 the length of plate 44 increases back to its original length.

Figure 5:
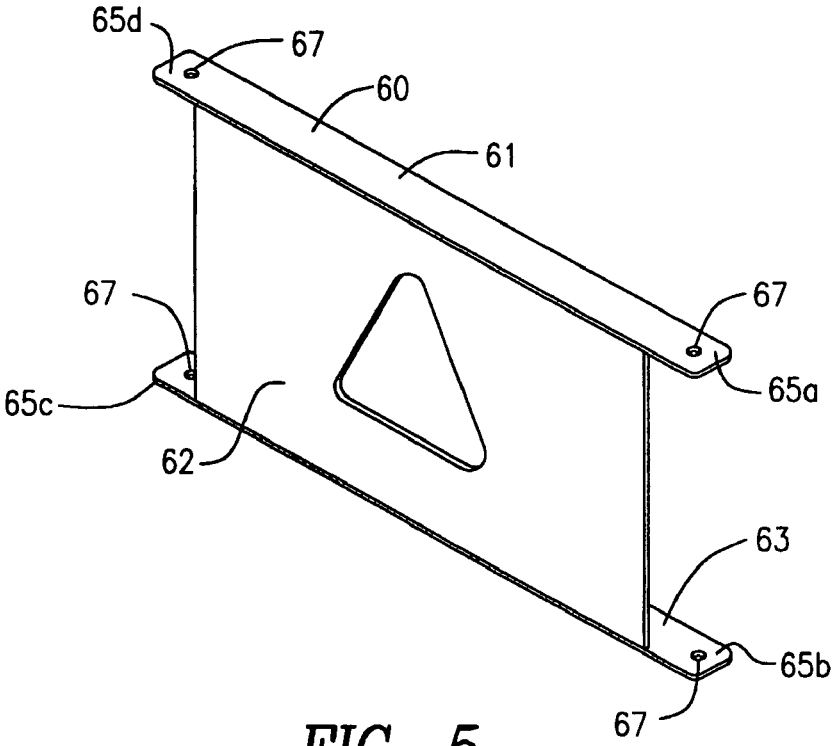
FIG. 5 is a perspective view of a blocking structural framing component.

Finally, turning to FIGS. 5 and 6, blocking component 60 is seen to have web 62, upper flange 61, lower flange 63 and securing tabs 65*a, b, c* and *d*. Appearing in cross section, component 60 may either be a "C" shaped channel or an "I" shaped channel. In addition, securing tabs 65*a-d* can either be separate structures attached to flanges 61 and 63, or may be formed integrally therewith, so long as tabs 65*a-d* extend past the ends of web 62 so that they can be attached between adjacent components 30, as seen in FIG. 6 through predrilled holes 67.

Unless otherwise expressly indicated, when used throughout this document the term "substantially" shall have the meaning of "approximation", not "magnitude"; i.e., it shall have the meaning, "being largely but not wholly that which is specified." See, *Webster's Ninth New Collegiate Dictionary*, Merriam-Webster Inc., 1989. Hence, applicant is not using the term "substantially" to denote "considerable quantity" or "significantly large," but is instead using the term as a qualifier/minimizer of a term. For example, in the fictitious phrase "the head portion is substantially above the body portion," using the above intended definition, the phrase "substantially above" is meant to indicate that while most of the head portion can be located above the body portion, there is certainly at least some of the head portion located in planes with the body portion, or even below parts of the body portion. As a further example, as used in the fictitious phrase "substantially hollow," using the above intended definition, the phrase "substantially" is meant to indicate that there are areas where the item is not hollow, without regard to a quantity of hollow verses non-hollow areas. These examples are meant to be illustrative of the meaning to be attributed to the term "substantially" as used throughout this document, even if these particular phrases are not found herein.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the inventions herein described and all statements of the scope of the inventions, which, as a matter of language, might be said to fall therebetween.

What is claimed is:

1. A structural framing system, comprising:

at least one first framing component having a length and having upper and lower flange elements separated by a web element, said web having a depth as measured between said upper and lower flange elements, said upper and lower flange elements each having corresponding upper and lower positioning dimples spaced therealong the length of the first framing component, said upper dimples protruding from said upper flange element toward said lower flange element and said lower dimples protruding from said lower flange element toward said upper flange element in such manner that a distance between a lower most surface of said upper dimples and an upper most surface of said lower dimples is less than said depth;

at least one second framing component having a web and flanges extending from sides of said web in a first direction, and a depth adapted to fit between said upper and lower flange elements of said first framing component, said second framing component further adapted to extend from positions along said first framing component substantially corresponding to said corresponding upper and lower positioning dimples; and at least one third framing component for securing together said first and second framing components, said third framing component comprising:

a first plate member adapted to be secured to said web of said first framing component and having a height substantially equal to said depth of said web of said first framing component; and a second plate member adapted to be secured to a surface of the web of said second framing component so that the first place member extends perpendicular to said web opposite from said direction in which said flanges extend, a portion of said second plate member having a height less than said distance between said surfaces of said dimples so as to avoid interference with said dimples during attachment of said third framing component to said first and second framing components.

2. A structural framing system as recited in claim 1, said at least two dimples of said upper flange being separated from each other by a distance along said upper flange sufficient to loosely hold therebetween a thickness of an upper portion of said second framing component and said at least two dimples of said lower flange being separated from each other by a distance along said lower flange sufficient to loosely hold therebetween a thickness of a lower portion of said second framing component.

3. A structural framing system as recited in claim 2, said second framing component able to freely stand when said respective thicknesses thereof are seated between said at least two upper and at least two lower dimples, without securing said third framing component between said first and second framing components.

4. A structural framing system as recited in claim 1, said first and second plate members of said at least one second framing component substantially perpendicular to each other.

5. A structural framing system as recited in claim 1, further comprising at least another second framing component in spaced apart relation along said at least one first framing component to said at least one second framing component.

6. A structural framing system as recited in claim 1, wherein said at least one second framing component is a plurality of second framing components corresponding in locations along said at least one first framing component to locations of said positioning dimples.

7. A structural framing system as recited in claim 6, wherein adjacent second framing components of said plurality of second framing components are braced together along lengths thereof by at least one fourth framing component.

8. A structural framing system as recited in claim 7, said at least one fourth framing component, comprising:

a web element having a length allowing it to fit between said adjacent second framing components;

upper and lower flange elements, each having first and seconds ends; and securing tabs extending from said first and second ends of said upper and lower flange elements, said securing tabs for attaching said at least one fourth framing components to said adjacent second framing components.

9. A structural framing system as recited in claim 8, said securing tabs extending integrally from said ends of said upper and lower flange elements of said at least one fourth framing component beyond said length of said web element on either side of said length of said web element.

10. A fourth structural framing component as recited in claim 8, being "C" shaped in cross-section.

11. A fourth structural framing component as recited in claim 8, being "I" shaped in cross-section.

* * * * *